United States Patent [19]

James

[11] 4,121,503

[45] Oct. 24, 1978

[54] VARIABLE DISPLACEMENT PUMP

[75] Inventor: Nicholas Antony James, Wotton-under-Edge, England

[73] Assignee: Plessey Handel und Investments AG, Zug, Switzerland

[21] Appl. No.: 767,821

[22] Filed: Feb. 11, 1977

[30] Foreign Application Priority Data

Feb. 14, 1976 [GB] United Kingdom ..... 5891/76

[51] Int. Cl.[2] ..... F01B 3/02

[52] U.S. Cl. ..... 91/505

[58] Field of Search ..... 91/499, 504, 505, 506; 92/12.2; 417/222, 218

[56] References Cited

U.S. PATENT DOCUMENTS

| | | | |
|---|---|---|---|
| 2,409,185 | 10/1946 | Blasutta | 91/473 |
| 2,708,879 | 5/1955 | Van Meter | 91/506 |
| 3,266,434 | 8/1966 | McAlvay | 417/222 |
| 3,960,061 | 6/1976 | Campbell | 91/506 |

*Primary Examiner*—Carlton R. Croyle
*Assistant Examiner*—Leonard E. Smith
*Attorney, Agent, or Firm*—Fleit & Jacobson

[57] ABSTRACT

A variable displacement pump comprising a housing, a pair of removable side plates and a swash plate which is so pivoted about the side plates that a load on the swash plate is transmitted to each side plate in a single plane which is substantially parallel to the plane of the side plates.

2 Claims, 6 Drawing Figures

VARIABLE DISPLACEMENT PUMP

This invention relates to a variable displacement pump.

Variable displacement pumps employing swash plates are well known. In such a variable displacement swash plate pump, the swash plate is tilted to various angles to vary the output of the pump. Loads on the swash plate are transmitted to the pump casing or housing. In the known pumps, these loads are transmitted from the swash plate to the pump housing over somewhat complex paths which often include cranked arms. This makes the known pumps bulky and reinforcing members are sometimes needed.

It is an aim of the present invention to provide a compact pump in which loads on the swash plate are easily transmitted to the pump housing.

Accordingly, this invention provides a variable displacement pump comprising a housing, a pair of removable side plates, and a swash plate which is so pivoted about the side plates that a load on the swash plate is transmitted to each side plate in a single plane which is substantially parallel to the plane of the side plates.

Preferably, each side plate has a pin for supporting the swash plate, and a support for the pin for accepting a load in the pin resulting from the load on the swash plate.

Advantageously, the swash plate is a multi-part swash plate. The multi-part swash plate may comprise a flat body portion having collars at each end. One or both of these collars may be removably attached to the body part.

An embodiment of the invention will now be described solely by way of example and with reference to the accompanying drawings in which.

Figure 1:
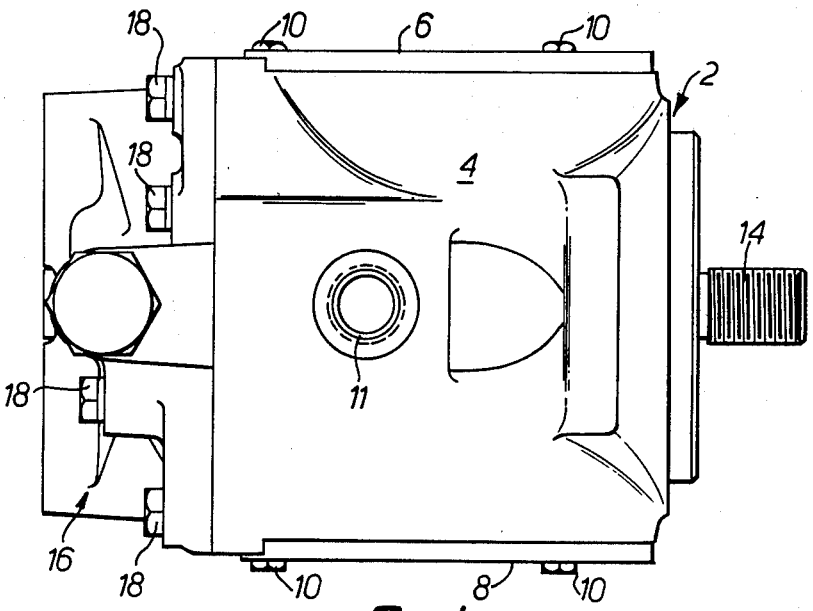
FIG. 1 is a side view of a variable displacement pump in accordance with the invention.
Figure 2:
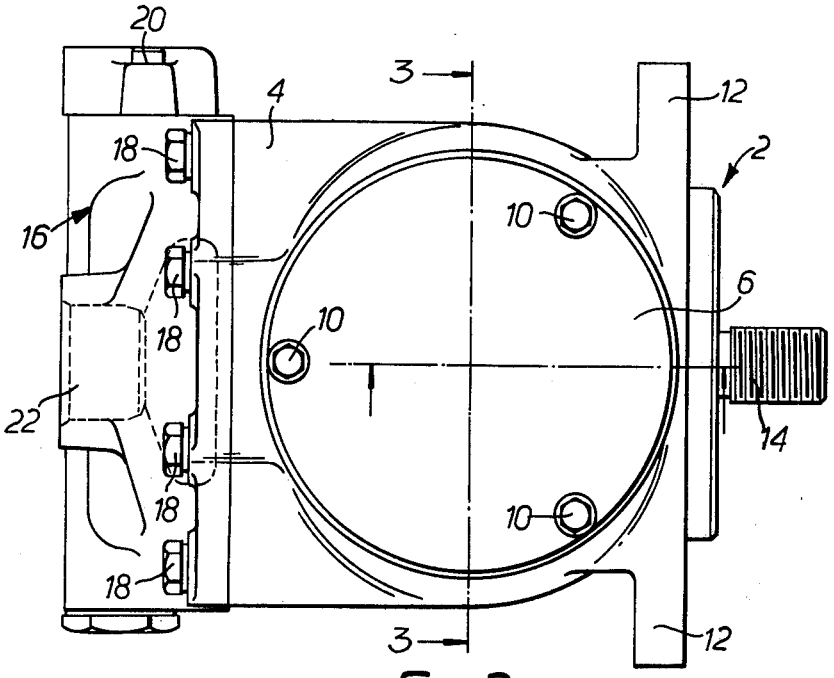
FIG. 2 is a top view of the pump shown in FIG. 1.

Referring to the drawings and especially to FIGS. 1 and 2, there is shown a pump 2 comprising a housing 4 having removable side plates 6, 8 attached thereto by means of bolts 10. The housing 4 is also provided with an outlet pipe 11 and two flanged portions 12 having apertures 13 (FIG. 3) for enabling the pump 2 to be fixed in a desired location. Extending through the housing 4 is a shaft 14. O-ring seals 15, 17 are respectively provided on the side plates 6, 8.

Attached to the housing 4 is a pump cover portion 16. The portion 16 is attached to the housing 4 by means of bolts 18. The portion 16 is provided with flow conduits 20 and 22.

Figure 3:
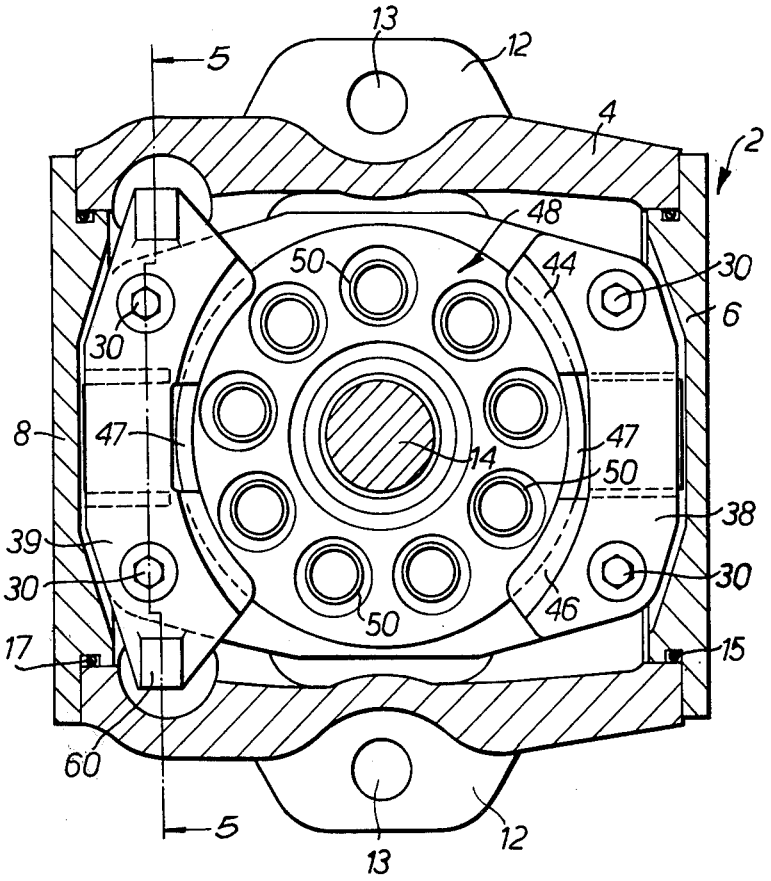
FIG. 3 is a cross sectional view on the line 3—3 shown in FIG. 2.
Figure 4:
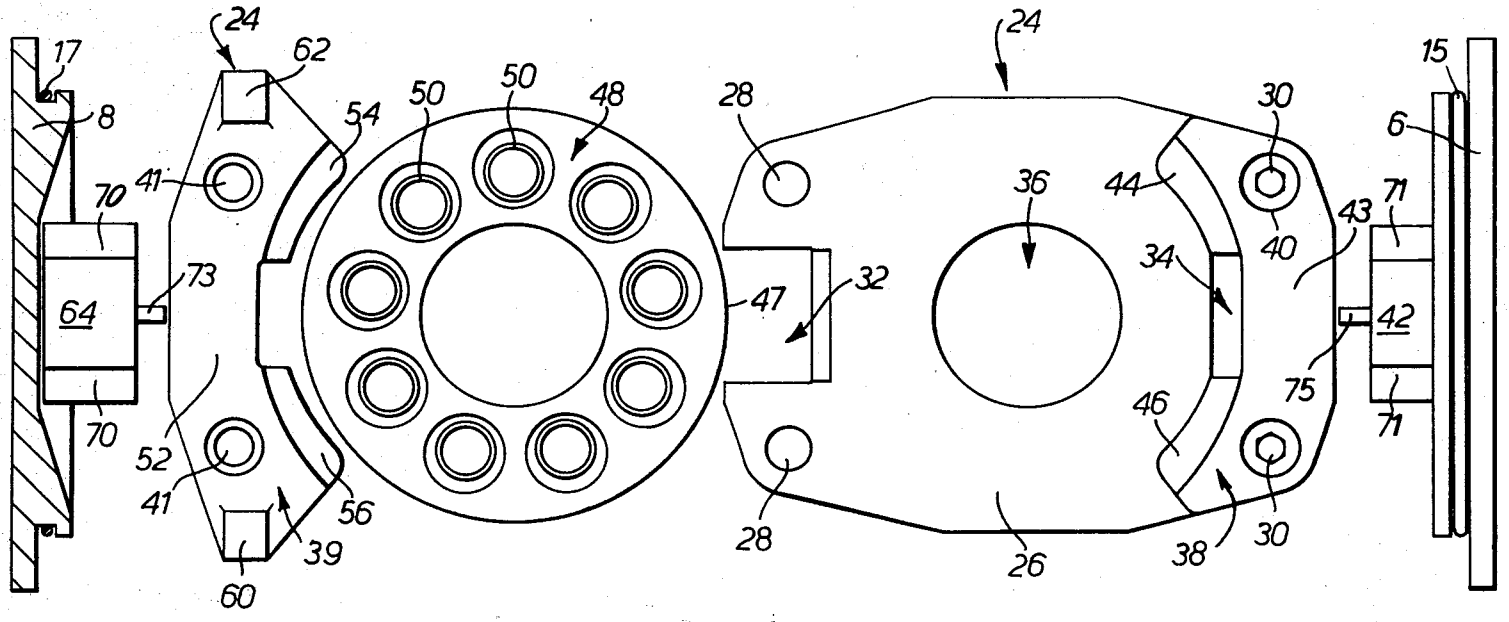
FIG. 4 is an exploded view of parts of the pump shown in FIG. 3.

Referring especially now to FIGS. 3 and 4, the pump 2 is shown having a swash plate 24 positioned within the housing 4. The swash plate 24 is shown most clearly in FIG. 4 and it will be seen that the swash plate comprises a flat body portion 26 having screw threaded apertures 28 for receiving bolts 30. The body portion 26 is provided with two cut out parts 32, 34 and is provided with a central aperture 36 for receiving the shaft 14. Two bridge members 38, 39 are attached to the ends of the body portion 26 by means of the bolts 30 which pass through holes 40, 41 respectively in the bridge members 38, 39 and then extend into the holes 28 in the body portion 26.

The bridge member 38 comprises a central portion 43 and provides an aperture for receiving a pin 42 attached to the side plate 6. Projecting from the bridge member 38 are two flanges 44, 46 which are spaced above the body portion 26 so that a space is formed between the body portion 26 and the flanges 44, 46. Into this space is inserted part of the lip 47 of a plate 48 which contains pumping pistons 50.

The bridge member 39 is similarly constructed to the bridge member 38 and thus comprises a central portion 52 and flanges 54, 56. The flanges 54, 56 define a space above the body portion 26 so that a space is formed between the body portion 26 and the flanges 54, 56. This space houses part of the lip 47 of the plate 48. The collar 52 is also provided with two lugs 60, 62. A pin 64 on the side plate 8 extends into the aperture formed between the central portion 52 of the bridge member 39 and the body portion 26.

Figure 5:
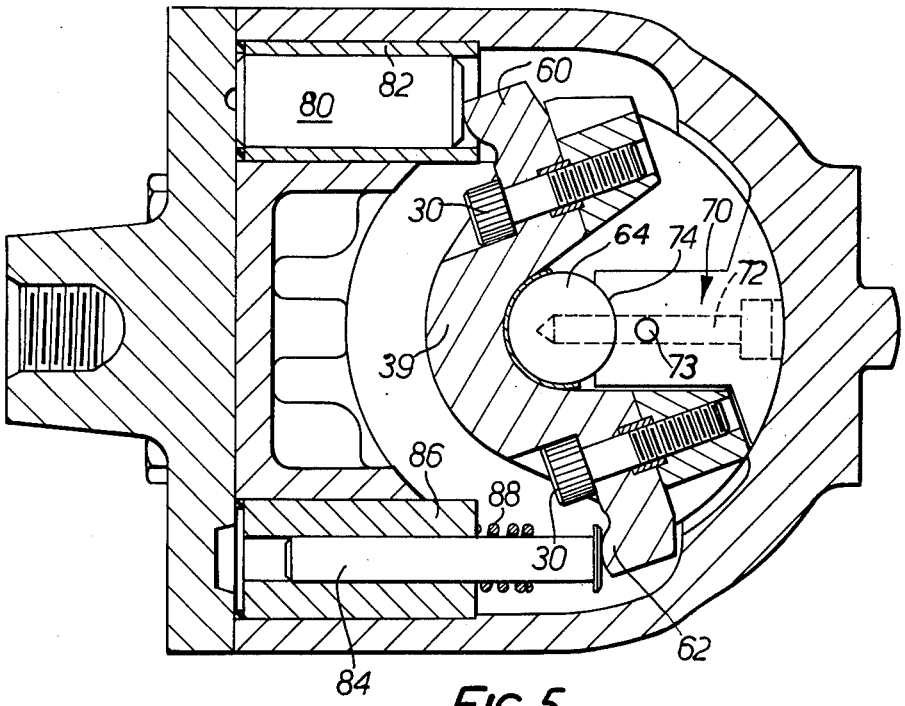
FIG. 5 is a cross sectional view on the line 5—5 shown in FIG. 3.

As shown in FIG. 5, the side plate 8 has a support member or leg 70 for supporting the pin 64. The side plate 6 has a similar support member or leg 71, part of which is shown in FIG. 4. The leg 70 is provided with a bolt hole 72 for enabling the pin 64 to be secured in the recessed portion 74 of the leg 70. The leg 71 is provided with a similar drilling (not shown). The leg 70 is provided with a pin 73 and the leg 71 is provided with a pin 75. The legs 70, 71 are formed integrally with their side plates 8, 6 respectively. A force or load on the pins 42, 64 is transmitted directly to the legs 71, 70 since the pins sit in the recessed portions 74 formed at the extremity of each leg 70, 71. The load in a leg 70 or 71 is then in a plane parallel to the plane of the main body part of the end plates 6, 8. The load can thus easily be accepted by the end plates 6, 8 and there is little tendency for the end plates 6, 8 to buckle as would be the case if the loads were applied perpendicularly to the end plates 6, 8.

The lugs 60, 62 formed on the bridge member 39 each press on a piston-and-cylinder arrangement. More specifically, the lug 60 presses on a piston 80 provided in a cylinder 82. When this piston 80 moves to the right as shown in FIG. 5, the bridge member 39 and therefore the remainder of the swash plate 24 is moved to a deswashed condition. The lug 62 presses on a piston 84 which operates in a cylinder 86. Piston 84 is partially surrounded by a biassing spring 88. When the piston 84 moves to the right as shown in FIG. 5, then the bridge member 39 and therefore the remainder of the swash plate 24 is moved to an on-swash condition. The precise action of the piston-and-cylinder arrangements 80, 82 and 84, 86 is well known in variable displacement pumps and will not be described in further detail.

Figure 6:
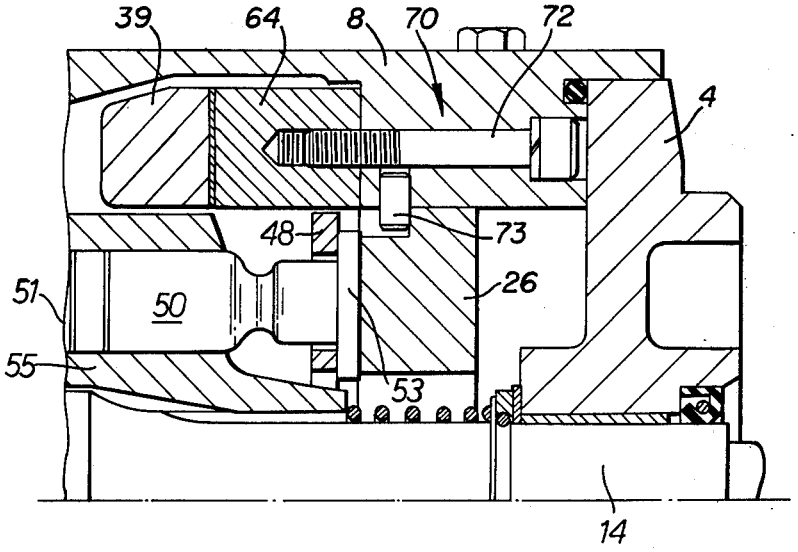
FIG. 6 is a part sectional view of a part of the pump shown in FIGS. 1 to 5.

The precise angle of the swash plate 24 affects the pumping stroke of the pumping pistons 50 in their cylinders 51 (FIG. 6) and more or less fluid is pumped by the pump 2 depending therefore upon the angle of the swash plate. More specifically, the shaft 14 is rotated, e.g. by a motor (not shown), and this causes a rotor 55 to rotate. Rotation of the rotor 55 causes the pistons 50 to rotate with the plate 48, and slippers 53 which are attached to the pistons 50 slide around the inclined face of the swash plate and draw the pistons in and out of their cylinders 51 to suck and pump liquid. The precise pumping action of the pistons 50 is also well known and will not be described in further detail herein. The pins 73, 75 ensure that the swash plate 24 remains on the pins 42, 64 when the pump is not pumping and there is little or no load on the swash plate.

The construction of the pump of the present invention is advantageous in that easy assembly is facilitated in addition to the above-mentioned facility of the side plates being easily able to take the load applied to the swash plate. More specifically, with regards to the compact facility, the body portion 26 of the swash plate 24 can be provided with the bridge member 38 as shown in FIG. 4 and then the combined body portion 26 and bridge member 38 can be slid on to the pin 42 of the end plate 6, which end plate will usually already have been secured on the housing 4. Thereafter, the plate 48 can be slid in position. The bridge member 39 can then be placed in position so that its flanges 54, 56 also overlap the periphery 47 of the plate 48 and then the bridge member 39 can be secured to the body portion 26. Subsequently, the end plate 8 can be located in position.

It is to be appreciated that the embodiment of the invention described above has been given by way of example only and that modifications may be effected.

What we claim is:

1. A variable displacement pump comprising a housing, a pair of removable side plates forming part of the housing, a pair of pins, a pair of support members each of which forms part of one of the side plates and each of which has a recess formed in an upper surface for receiving the whole length of one of the pins, and a swash plate which is adapted to pivot about the pins, the pump being such that a load on the swash plate is transmitted through the pins to the support members and through the support members to the housing, and each pin being subjected solely to in-line compressive loads between its said support member and the swash plate since each pin is supported over its whole length in the recess in its said support member.

2. A variable displacement pump according to claim 1 in which the swash plate is a multi-part swash plate having a flat body portion having collars at each end, at least one of said collars being removably attached to the body portion.

* * * * *